United States Patent [19]

Lassiter

[11] Patent Number: 4,838,380

[45] Date of Patent: Jun. 13, 1989

[54] NYLON IMPRESSION FABRIC-ACOUSTICAL APPLICATION

[75] Inventor: B. Dean Lassiter, Greensboro, N.C.

[73] Assignee: Burlington Industries, Inc., Greensboro, N.C.

[21] Appl. No.: 905,399

[22] Filed: Sep. 10, 1986

[51] Int. Cl.[4] ..... E04B 1/82

[52] U.S. Cl. ..... 181/291; 181/286; 181/290; 181/294

[58] Field of Search ..... 181/286, 290, 291, 294, 181/DIG. 1, 296, 287, 284, 295

[56] References Cited

U.S. PATENT DOCUMENTS

| | | | |
|---|---|---|---|
| 3,748,799 | 7/1973 | Tough et al. | 52/144 |
| 3,971,867 | 7/1976 | Randall | 52/145 X |
| 4,056,161 | 11/1977 | Allen, Jr. | 181/290 |
| 4,057,123 | 11/1977 | Erickson | 181/286 |
| 4,097,633 | 6/1978 | Focht | 181/294 X |
| 4,146,999 | 4/1979 | Petrovec et al. | 52/145 |
| 4,193,474 | 3/1980 | Okubo et al. | 181/290 X |
| 4,194,339 | 3/1980 | Wendt | 181/291 X |
| 4,241,806 | 12/1980 | Metzger | 181/284 |
| 4,247,586 | 1/1981 | Rochlin | 181/284 X |
| 4,313,524 | 2/1982 | Rose | 181/291 |
| 4,340,129 | 7/1982 | Salyers | 181/290 X |
| 4,428,454 | 1/1984 | Capaul et al. | 181/290 |
| 4,480,715 | 11/1984 | Brooks | 181/287 |
| 4,605,093 | 8/1986 | Karlen | 181/295 |

*Primary Examiner*—Benjamin R. Fuller

*Attorney, Agent, or Firm*—Nixon & Vanderhye

[57] ABSTRACT

Nylon impression fabric is used as a cover fabric for an acoustical material (e.g., 1 inch thick polyester foam) substrate in an environment—such as a textile workplace environment having textile machinery such as texturing air jets—to provide for good sound absorption while being easily cleanable, and having other desirable properties that lead to significant high frequency (e.g., 4000–20000 Hz) noise reduction over long periods of time. The substrate and fabric combination has an HFNRC (high frequency noise reduction coefficient) of at least about 0.80. The facing fabric has a fractional cover factor of about 0.80, a coefficient of friction of less than about 0.30, an air porosity of about 10–50 cfm, and a Taber abrasion resistance of greater than about 400 cycles. The facing fabric preferably is uncoated, and is not full surface bonded to the substrate (e.g., either wrapped or point bonded).

7 Claims, 4 Drawing Sheets

NYLON IMPRESSION FABRIC-ACOUSTICAL APPLICATION

BACKGROUND AND SUMMARY OF THE INVENTION

In certain textile applications, high frequency noise sources require acoustical materials having good absorption characteristics. It is known, for example, that texturing air jets typically produce noise concentrated above 4000 Hz and predominantly in the 8000 Hz to 16,000 Hz octave bands.

Because textile machinery oftentimes operates in an atmosphere laden with dust and other particulate matter such as lint, acoustical material, such as 1 inch thick foam, must include a facing which is easily cleanable and which prevents contamination of the acoustical material. However, known facing material, such as fiberglass, coarse polyester fabrics and films such as vinyl and polyester, adversely affect the high frequency noise absorption characteristics of the acoustical material.

It is the dual object of this invention to provide a facing material which does not impair good high frequency absorption characteristics of acoustic materials, and to provide a protective facing material which is easily cleaned and maintained.

The rate at which sound is absorbed in a room or enclosure is a prime factor in reducing noise and controlling reverberation (the persistence of sound due to repeated reflection at the boundaries). Sound is absorbed by a mechanism which converts the sound into other forms of energy and ultimately into heat. The efficiency of a material in absorbing acoustical energy at a specified frequency is given by its absorption coefficient at that frequency. This quantity is the fractional part of the energy of an incident sound wave that is absorbed (not reflected) by the material. For example, if sound waves strike a material in which 55% of the incident acoustical energy is absorbed and 45% is reflected, the sound-absorption coefficient of the material is 0.55.

One important method for determining the sound-absorption coefficient is provided by the reverberation room measurement procedure. With this method, the reverberation time (the measurement of the rate of decay of the sound in an enclosure after the sound source has stopped. Quantitatively, the time in seconds required for the measured sound pressure level in the enclosure to decay by 60 dB) of a room having sound-reflecting walls, floor and ceiling is measured as a function of frequency before and after placing a known area of absorbent in the room. From measurements of reverberation time, taken with and without the absorbent present, the sound-absorption coefficient can be calculated using the well-known Sabine reverberation equation. The absorption coefficient determined in a reverberation room invariably exceeds the true absorption coefficient. One interesting aspect of the problem is the fact that, for a highly-absorbing material, the value of the sound-absorption coefficient can exceed unity, sometimes by as much as 20% or 30%. Of course, it is impossible for a surface to absorb more sound power than its geometrical area would seem to warrent. Since measured results that are greater than the ideal are not yet completely understood, it is recommended in the Standard (ASTM C423-66) that no adjustments be made for this cause. For this reason the sound-absorption coefficient measured from sound decay rates should be denoted and referred to as the Sabine absorption coefficient.

In a full-size reverberation room, the sound absorption due to air predominates at very high frequencies and is strongly dependent upon frequency and relative humidity (R.H.). This fact limits the usable upper frequency range of the measurement technique to approximately 4000 Hz (the upper limit of most standard laboratory measurements). Because present measurement techniques are limited to an upper frequency range of about 4000 Hz, most material manufacturers do not provide absorption data above 4000 Hz. This has made the determination of suitable facing fabrics for high frequency application problematic, particularly for use with airjet looms where frequencies in the 8000–16000 Hz bands predominate. In order to measure the sound-absorption coefficient of a material in the frequency range of 4000–20,000 Hz, it is necessary to scale down the sound absorption of air. This can be accomplished by scaling down the physical size of the reverberation room (i.e., scaling the volume of air absorption) and reducing the relative humidity inside the scale-model room to approximately 1%–2%.

A one-eighth scale-model reverberation room for measuring high-frequency sound-absorption coefficients was designed by scaling down the recommended requirements for a full-scale chamber as given in ASTM C423-66. In practice, the model chamber consisted of a rectangular enclosure constructed of 0.5-inch thick aluminum plate with an interior volume of 13.8 sq. ft. (29″×31″×27″). In order to observe the microphone position and gain access to the inside of the chamber, an acrylic sheet roof was used. Model acrylic diffusers were randomly suspended inside the chamber to help provide a diffused sound field. The inside air was dehumidified by circulating dry air from a desiccant compartment to approximately 1% R.H. for the measurements. A physically-small high-frequency loudspeaker was used as a sound source inside the room.

Typically, after the sound source in the enclosure was turned off, the decay of the logarithm of sound pressure (the sound pressure level) versus time was recorded on a digital storage oscilloscope. The reverberation time data was then calculated for each octave-band frequency of interest from 1000–16,000 Hz and entered into the computer for computation of the octave-band sound-absorption coefficient. In order to simplify the analyses of data generated in connection with this invention, a new terminology is introduced High Frequency Noise Reduction Coefficient (HFNRC). This is defined as the arithmetic average of the absorption coefficients in the 4k, 8k and 16k Hz octave bands.

The acoustical absorption characteristics of several potential facing fabrics were obtained in this manner and are discussed more fully below.

Other facing fabric parameters evaluated which have a direct bearing on acoustic properties include material thickness, and air permeability. Parameters more directly related to the fabric cleanability and contamination prevention, such as coefficient of friction, cover factor and abrasion properties were also evaluated. Other relevant considerations include the effects of bonding the facing fabric to the acoustic material, and the effects of coating the facing fabric.

As a result of extensive analysis and testing, it has been determined that a facing fabric possessing good acoustical and cleanability properties should have the following profile:

1. HFNRC: >0.80 (for facing over a 1" thick polyester foam substrate)
2. Fractional Cover Factor: =about 0.8 (no greater)
3. Coefficient of Friction: <about 0.30
4. Taber Abrasion: >about 400 cycles
5. Air porosity: about 10–50 cfm
6. Fabric Configuration: Plain Weave, continuous filament flat or torque textured yarns with no twist.
7. Facing should be unbonded (or pattern bonded) to acoustical substrate.
8. Facing should not be coated.

In accordance with the above profile, nylon impression fabric (NIF), which receives its name from its conventional use as typewriter ribbon, has been found to combine good acoustical properties with good cleanability and contamination prevention characteristics. Specifically, in one exemplary embodiment of the invention, a 3 or 5 mil thick NIF facing layer is wrapped about a one inch thick foam substrate. It is of some significance that the facing not be bonded to the substrate, although a point or pattern bond system may be acceptable.

BRIEF/DESCRIPTION OF THE DRAWINGS

DETAILED DESCRIPTION OF THE DRAWINGS

Figure 1:
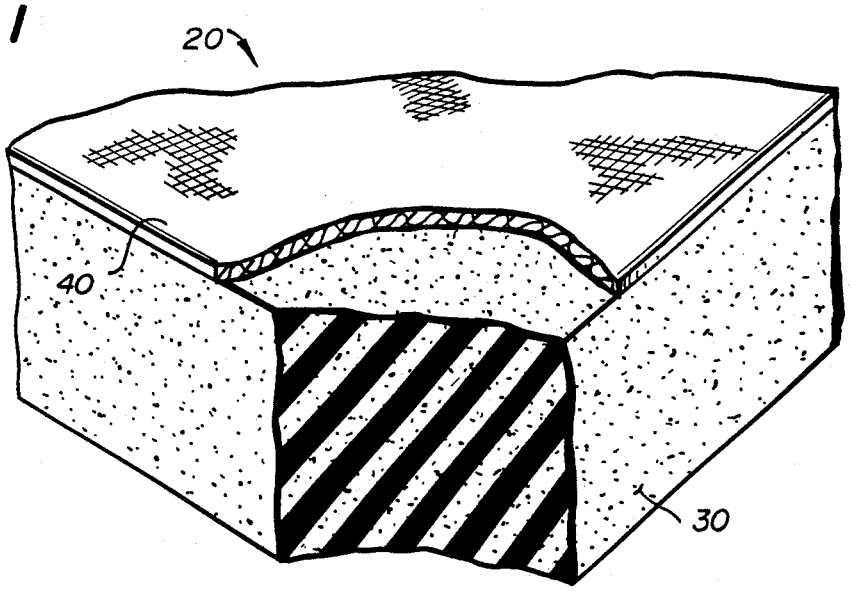
FIG. 1 illustrates a partial sectional view of an acoustic substrate and facing fabric layer in accordance with this invention.

In FIG. 1 there is illustrated a perspective view, partly in section, of a portion of acoustic material in accordance with an exemplary embodiment of this invention. The material 20 include a substrate 30 of material such as one inch thick polyester foam with good high frequency noise absorption characteristics. A relatively thin facing layer 40, preferably 3 or 5 mil in thickness, overlies the substrate. The facing layer 40 is preferably a nylon impression fabric (NIF) which, at high frequencies in the 4000 Hz to 16,000 Hz range, does not significantly adversely affect the acoustic properties of the foam, i.e., it is pervious to high frequency noise.

Figure 2:
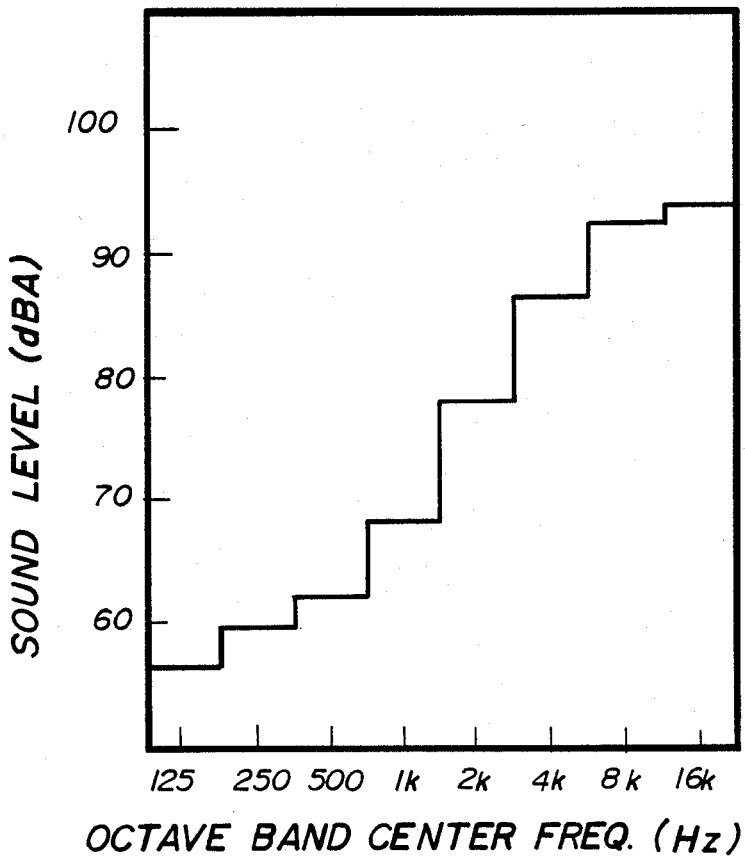
FIG. 2 is a graph illustrating the noise spectrum typically associated with a texturing airjet.

The graph illustrated in FIG. 2 demonstrates the significant amount of noise in the 4K to 16K Hz octave bands, characterized as high frequency noise, typically associated with texturing airjet. Other machinery in textile workplace environments also have significant amounts of noise between 4K–16K Hz.

In Table I below, absorption coefficients at various frequencies are given for several facing fabrics applied over one inch thick polyester foam substrates. The absorption coefficient for unfaced foam is also given to clearly illustrate the generally significant adverse affect of facing layers. The far right column indicates the HFNRC parameter, which parameter was developed in the course of making this invention.

TABLE I

| | Facing Absorption Coefficients | | | | | |
|---|---|---|---|---|---|---|
| | Octave Band Center Frequency | | | | | |
| Fabric Configuration | 1000 | 2000 | 4000 | 8000 | 1600 | HFNRC |
| 1" foam - no face | 1.10 | 1.08 | 0.99 | 1.08 | 1.06 | 1.04 |
| 1" foam w/MYLAR face | 0.39 | 0.38 | 0.42 | 0.44 | 0.35 | .40 |
| 1" foam w/NIF face | 0.83 | 0.81 | 0.80 | 0.86 | 0.78 | .81 |
| 1" foam w/NIF face & full adhesive bond | 0.80 | 0.59 | 0.63 | 0.67 | 0.51 | .60 |
| NIF face & 1" air space | 0.44 | 0.59 | 0.68 | 0.63 | 0.63 | .65 |
| 1" foam w/fiberglass face | 0.97 | 0.84 | 0.82 | 0.92 | 0.85 | .86 |
| 1" foam w/fiberglass face-coated | 0.64 | 0.46 | 0.51 | 0.47 | 0.43 | .47 |
| 1" foam w/Versatech face | 0.68 | 0.47 | 0.48 | 0.36 | 0.31 | .38 |
| 1" foam w/ nylon supplex | 0.60 | 0.50 | 0.51 | 0.45 | 0.40 | .45 |
| 1" foam w/poly. mockleno | 1.04 | 1.01 | 0.96 | 1.08 | 1.00 | 1.01 |
| 1" foam w/poly. sandcrepe | 0.92 | 0.96 | 0.92 | 1.02 | 0.97 | .97 |
| 1" foam w/poly. satin | 0.75 | 0.65 | 0.74 | 0.75 | 0.75 | .75 |
| 1" foam w/poly. taffeta | 0.76 | 0.66 | 0.77 | 0.80 | 0.81 | .79 |
| 1" foam w/poly. Dupreme | 1.03 | 0.97 | 0.94 | 1.09 | 1.00 | 1.01 |
| 1" foam w/poly. broadcloth | 0.91 | 0.92 | 0.90 | 1.04 | 0.99 | .98 |
| 1" foam w/poly. Palace | 1.01 | 0.99 | 0.98 | 1.02 | 0.98 | .99 |
| 1" foam w/poly. Ultressa | 1.13 | 1.09 | 1.02 | 1.08 | 1.04 | 1.05 |

Figure 3:
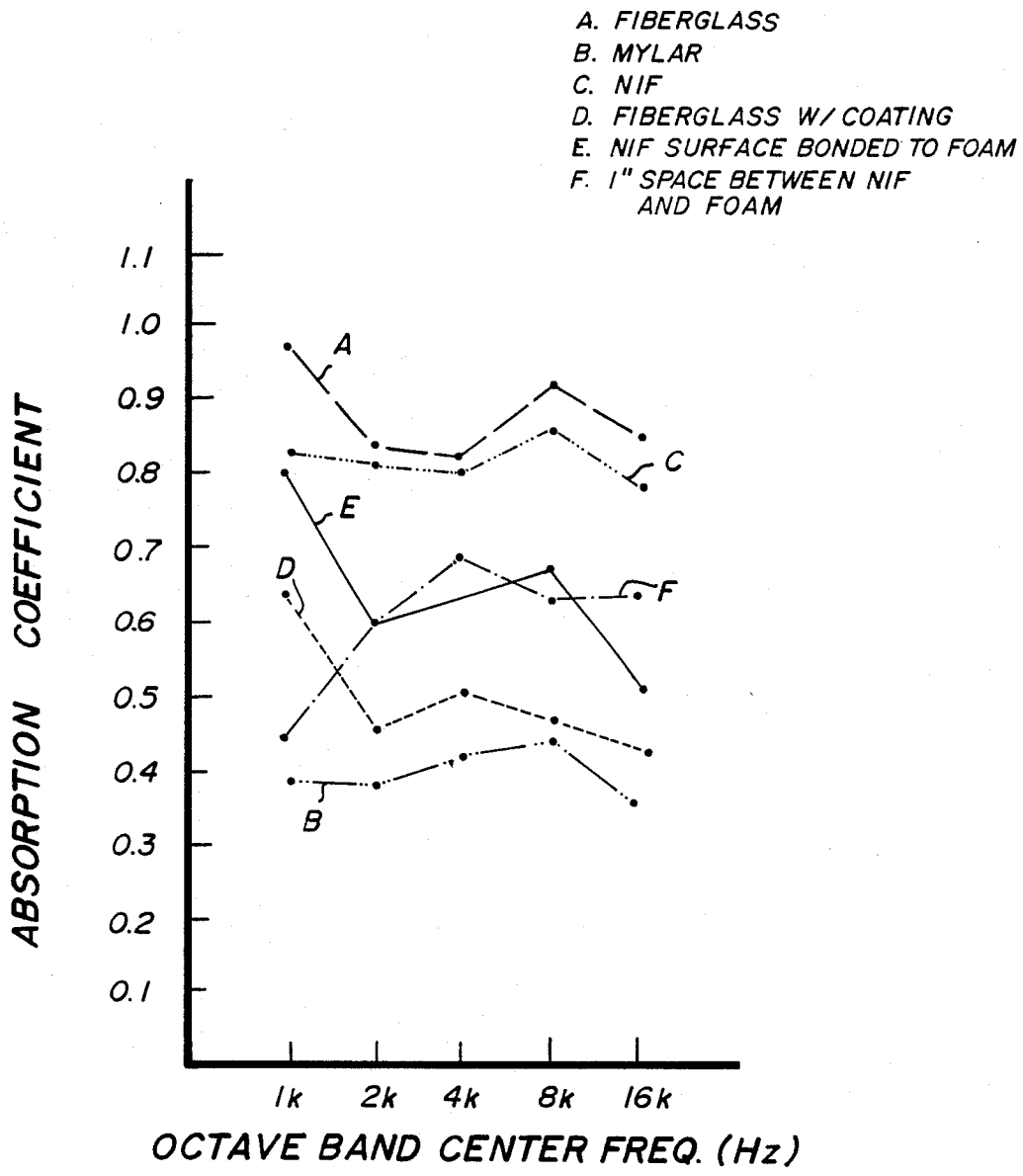
FIG. 3 is a graph illustrating absorption coefficients for various octave bands of NIF, MYLAR and fiberglass.

Of the fabrics included in Table I, MYLAR film and fiberglass are currently most often used as acoustical material facings. FIG. 3 of the drawings shows, among other things, a comparison of the absorption characteristics of fiberglass (plot A), MYLAR (plot B), and NIF (plot C) when combined with a substrate of one inch thick polyester foam. In this limited respect, the NIF and fiberglass are clearly superior to MYLAR. Due to the nature of fiberglass however, the use of a coating is sometimes required to stabilize the weave, especially if the weave of the fabric is to subjected to any cleaning action. As illustrated by plot D, coating the fiberglass significantly adversely affects its noise absorption characteristics.

FIG. 3 also illustrates the adverse effects associated with full cover adhesive bonding of the facing fabric to the substrate. In this regard, plot E represents an NIF facing layer bonded to the foam substrate. It is noteworthy that even with full surface bonding the NIF fabric remains superior to MYLAR.

Finally, there is illustrated in FIG. 3, a plot F which shows the effect on noise reduction of utilizing an NIF facing over a one inch airspace. While the noise reduction capability is reduced in comparison to a wrapped NIF facing layer, here again the NIF remains superior to MYLAR.

It is apparent then from FIG. 3 that NIF is superior to coated fiberglass and MYLAR in terms of noise absorption capability. In addition, FIG. 3 establishes that at least with respect to NIF, that an unbonded wrapped configuration is best. If wrapping is otherwise not satisfactory, point or pattern bonding is preferable to full surface bonding.

In determining the HFNRC criteria for acceptability, it was found that the faced acoustical material should provide an additional 3.0 dBA noise reduction, compared to a MYLAR faced one inch thick foam material. Table II shows this criteria to be met by an HFNRC value of approximately 0.80 which is similar to that provided by NIF. Specifically, the following Table provides the expected noise reduction (NR) in a sample enclosure lined with 75% of the sample material when compared with an empty enclosure. The Table also shows the additional NR provided by the nylon-faced, one inch thick polyester foam compared with the MYLAR-faced foam.

Specification for the sample enclosure:

Inside Dimensions: 29"×31"×27"

Construction: ½"-thick alum. plate on 5 surfaces with a ½"-thick plexiglass top surface

TABLE II

| Material: 1" Foam | HFNRC | 2 kHz | 4 kHz | 8 kHz | 16 kHz | Ave. NR Due to Material | Additional NR Compared With MYLAR-Face Foam |
|---|---|---|---|---|---|---|---|
| MYLAR Face | .40 | 13.8 | 13.0 | 11.5 | 9.4 | 11.9 dB | 0.0 dB |
| Nylon Face | .81 | 17.1 | 15.8 | 14.4 | 12.8 | 15.0 dB | +3.1 dB |

Table III presents additional facing fabric parameter data for several fabrics. Yarn configuration, HFNRC, thickness, porosity and abrasion resistance are included.

TABLE III

| Fabric | ends/ in | picks/ in | Facing Parameters HFNRC | Denier warp | Denier filling | Thickness mil | Porosity cfm | Abrasion (Taber) |
|---|---|---|---|---|---|---|---|---|
| MYLAR | — | — | .40 | — | — | | 0.0 | — |
| fiberglass | 100 | 42 | .86 | 450 | 100 | 4.5 | 12.4 | 35 |
| fiberglass (coated) | 100 | 42 | .47 | 450 | 100 | 11.6 | | — |
| Versatech | 150 | 90 | .38 | 75 | 164 | 8.3 | 1.6 | 440 |
| nylon impression | 156 | 108 | .81 | 40 | 70 | 5.0 | 16.9 | 455 |
| nylon supplex | 144 | 68 | .45 | 70 | 70 | 15.4 | 3.2 | 1370 |
| polyester mockleno | 100 | 92 | 1.01 | 70 | 70 | 7.7 | 181.0 | 245 |
| polyester satin | 156 | 100 | .75 | 70 | 50 | 9.2 | 10.7 | 410 |
| polyester sandcrepe | 96 | 82 | .97 | 70 | 70 | 9.6 | 48.0 | 210 |
| polyester Ultressa | 105 | 90 | 1.05 | 70 | 70 | 16.1 | 134.0 | 1050 |
| polyester broadcloth | 94 | 80 | .98 | 70 | 70 | 9.4 | 80.9 | 800 |
| polyester taffeta | 164 | 76 | .79 | 70 | 70 | 10.2 | 12.3 | 200 |
| polyester palace | 185 | 97 | .99 | 50 | 70 | 9.2 | 99.0 | 200 |
| polyester Dupreme | 88 | 86 | 1.01 | 150 | 150 | 20.5 | 80.9 | 2250 |

While it quite apparent from table III that certain of the fabrics have higher HFNRC's than NIF, these fabrics prove unsuitable for other reasons. For example, polyester mockleno, sandcrepe, Dupreme, Palace, Ultressa and fiberglass all have HFNRC values higher than NIF. However, with the exception of fiberglass (uncoated), note that the porosity levels are also significantly higher than NIF. As will be discussed further hereinbelow, the higher permeability of these fabrics portends contamination problems which are sufficient to exclude all of these fabrics, with the exception of sandcrepe, from consideration as a facing fabric of choice.

Figure 4:
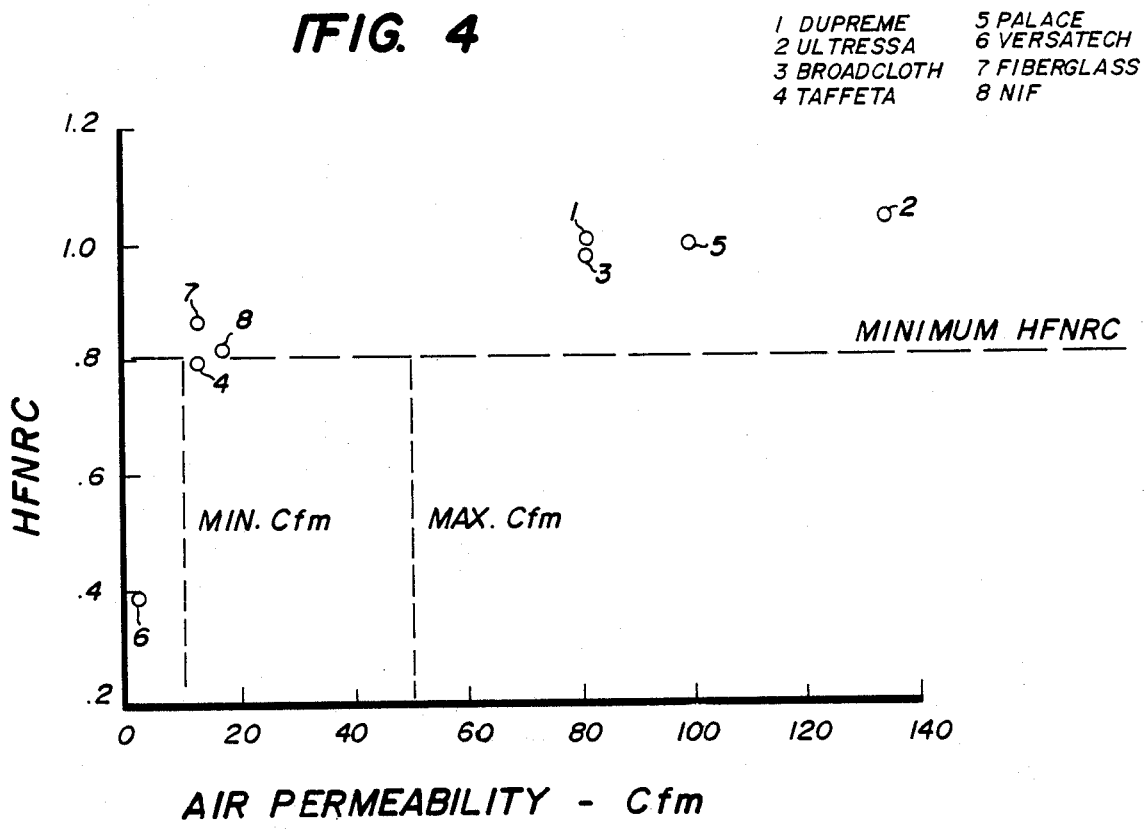
FIG. 4 is a graph relating air permeability to high frequency noise reduction coefficient for various facing fabrics.

FIG. 4 of the drawings clearly illustrates that relationship of air permeability, or porosity, and HFNRC. Higher levels of permeability give higher HFNRC's but with corresponding increases in contamination related problems. From the data presented in FIG. 4, it has been determined that 10–50 cfm is an acceptable range which minimizes contamination but which maintains the HFNRC near or at the acceptable HFNRC level of 0.80.

Table IV presents data relating coefficent of friction and cover factor. The latter is defined as the fraction of the surface areas of a fabric which is covered by yarns, assuming round yarn shape.

TABLE IV

| Fabric | Coefficient of Friction | Cover Factor |
|---|---|---|
| fiberglass | .232 | .84 |
| Versatech | .257 | .86 |
| nylon impression | .213 | .78 |
| polyester Ultressa | .351 | .66 |
| polyester broadcloth | .321 | .61 |
| polyester taffeta | .294 | .80 |
| polyester palace | .412 | .81 |
| polyester Dupreme | .218 | .80 |

Figure 5:
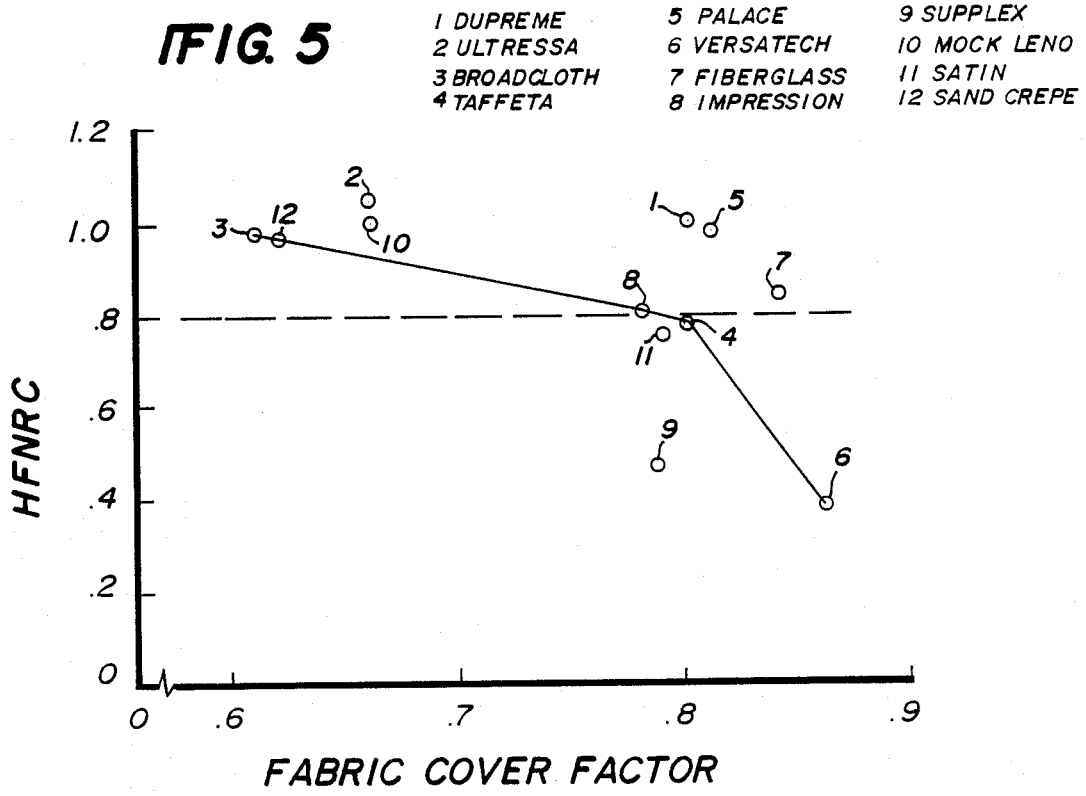
FIG. 5 is a graph relating fabric cover factor to high frequency noise reduction coefficient for various facing fabrics.
Figure 6:
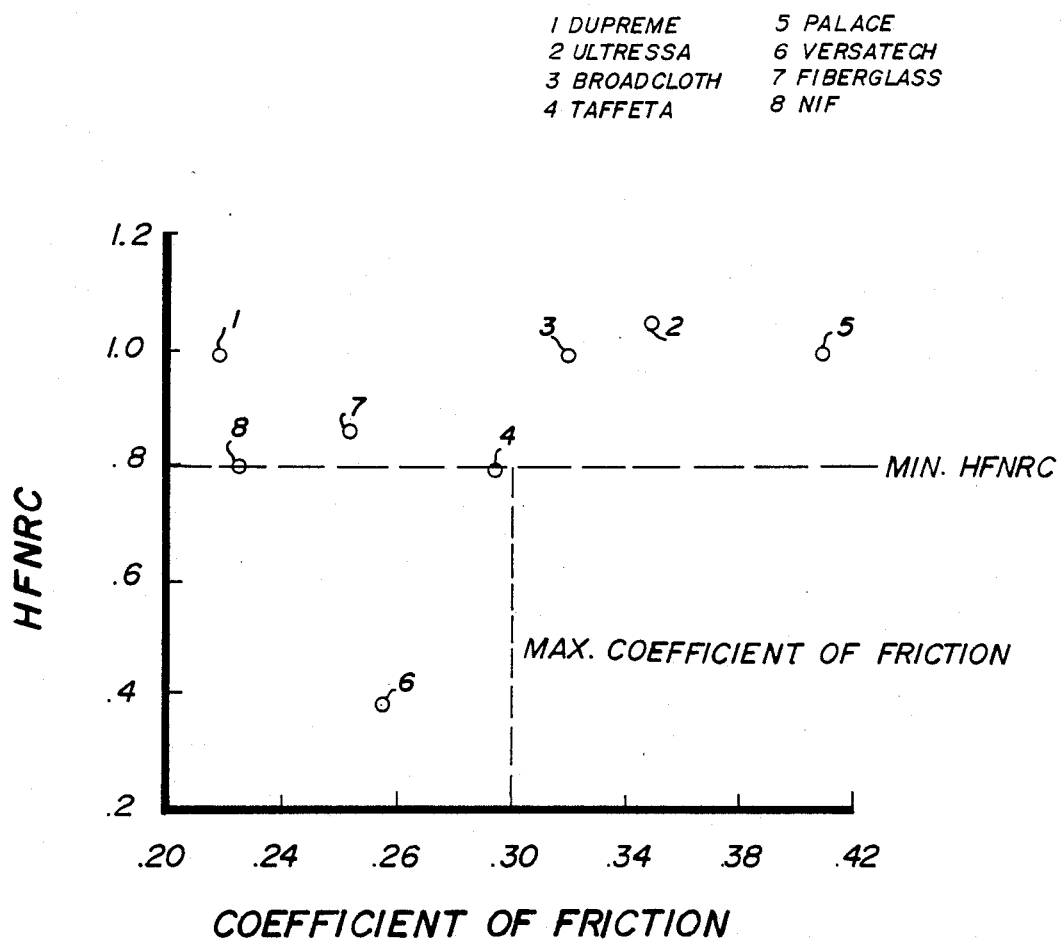
FIG. 6 is a graph which relates coefficient of friction to high frequency noise reduction coefficients for various fabrics.

The data included in Table IV should be viewed in conjunction with FIGS. 5 and 6 which relate coefficient of friction and cover factor to HFNRC. From FIG. 5, it can be seen that in order to maintain the HFNRC level at or near 0.80, the cover factor should also be 0.80. Higher cover factor values result in decreased noise absorption while lower cover factor values lead to contamination problems.

Similarly, from FIG. 6, it can be determined that, for acceptable HFNRC of 0.80, the coefficient of friction should be less than 0.30 in order to meet acceptable cleaning standards. These standards are based on the assumption that contaminants will move across the surface of the fabric more easily as the friction coefficient decreases.

It is further noted that the abrasion properties given in Table III are significant with respect to the cleanability of the facing fabric and, in this regard, values above 400 Taber cycles would be dictated, using NIF as a reference.

From analysis of all of the data presented above, only one fabric of those tested meets the profile set forth hereinabove for facing fabrics with good acoustical and cleanability/contamination properties, and that is nylon impression fabric (NIF).

Palace and Dupreme fabrics possess HFNRC values higher than 0.80 and cover factors of about 0.80. However, Palace has poor abrasion and porosity properties. In addition, the yarns of Palace fabric lay in zig-zag form, causing large spaces between the yarns. Moreover, the yarns are loose so that the crowns are bent out of the fabric plane, forming pockets between the warp and filling yarns. Dupreme also has poor porosity properties, the fabric showing large spaces between yarn and fibers because of the loose structure of the twill weave. These fabrics are therefore unsuitable for facings because of their potential for contamination.

Broadcloth is another fabric with a high HFNRC, but which is unsuitable as a facing fabric. Coefficient of friction and cover factor for the fabric are unacceptably low and the yarn structure is similar to that of Dupreme, as illustrated by its high porosity level.

Sandcrepe has poor abrasion properties and also exhibits loose structure, allowing penetration of contaminants, particularly when subjected to low air pressure conditions.

Fiberglass is unsuitable in spite of its high HFNRC and cover factor. The fabric structure is easily distorted, causing contamination. In addition, fiberglass has poor abrasion properties, and as noted above, often requires coating, which, in turn, dramatically reduces its HFNRC.

Ultressa fabric, also with high HFNRC, nevertheless is excluded by reason of high porosity, high coefficient of friction and low cover factor.

While taffeta exhibits a good HFNRC of 0.79, its cleanability is hampered by poor abrasion resistance.

Nylon supplex, satin and Versatech do not meet the minimum HFNRC's, and are therefore excluded without further consideration.

In summary, facing fabrics for acoustical material used in high frequency noise applications must exhibit good acoustic properties while, at the same time, must be easily cleanable to prevent contamination. By this invention, an acceptability profile has been developed taking into account parameters including a newly developed parameter "HFNRC", and the known parameters cover factor, coefficient of friction, abrasion resistance, porosity and fabric construction. Of twelve materials analyzed, only NIF proved acceptable.

It will be understood that the claims of this invention are intended to cover all modifications and changes therein which are within the skill of the art and which do not depart from the spirit and scope of the invention.

What is claimed is:

1. Sound absorbing means for use in high frequency noise environments, said means comprising:

(a) an acoustical material substrate;

(b) a fabric facing covering said substrate, wherein said sound absorbing means has a high frequency noise reduction coefficient of at least about 0.80, and said facing fabric has a fractional cover factor of substantially equal to, but not greater than about 0.80, a coefficient of friction of less than about 0.30, an air porosity of 10–50 cfm, and a Taber abrasion resistance of greater than about 400 cycles.

2. Sound absorbing means as defined in claim 1, wherein said acoustical material substrate comprises polyester foam and said facing fabric comprises nylon impression fabric.

3. Sound absorbing means as defined in claim 2, and wherein said foam substrate is about one inch thick and said facing fabric is from 3 to 5 mil thick.

4. Sound absorbing means as defined in claim 1, and wherein said facing fabric is uncoated.

5. Sound absorbing means as defined in claim 1, wherein said facing fabric is wrapped about said substrate without bonding.

6. Sound absorbing means as defined in claim 1, wherein said facing fabric is a plain weave construction, from continuous filament yarns having zero twist.

7. Sound absorbing means as defined in claim 1, wherein said facing fabric is point bonded to said substrate.

* * * * *